United States Patent [19]

Avery

[11] Patent Number: 4,625,457

[45] Date of Patent: Dec. 2, 1986

[54] INSULATING MEMBER FOR DOUBLE DOORS

[76] Inventor: Phillip E. Avery, 1485 Gold Hill Rd., Newcastle, Calif. 95658

[21] Appl. No.: 739,310

[22] Filed: May 30, 1985

[51] Int. Cl.[4] ..... E06B 3/32

[52] U.S. Cl. ..... 49/366; 49/488; 49/495; 49/368

[58] Field of Search ..... 49/366, 368, 495, 475, 49/488

[56] References Cited

U.S. PATENT DOCUMENTS 1,796,043 3/1931 Murphy ..... 49/366
2,739,358 3/1956 Kunkel ..... 49/495 X
4,204,369 5/1980 Hubbard ..... 49/366 X
4,241,539 12/1980 Josephson ..... 49/495 X
4,497,137 2/1985 Nelson ..... 49/495 X

*Primary Examiner*—Philip C. Kannan
*Attorney, Agent, or Firm*—Mark C. Jacobs

[57] ABSTRACT

An insulating member for installation on double doors comprising a flat flange member adapted to be secured to one of the doors and a resilient deformable portion on the member extending below the door on which it is mounted and providing sealing insulation when the other door is closed with respect to the door on which the member is installed. Fingers extending from a deformable section may extend the same or different distances.

5 Claims, 8 Drawing Figures

INSULATING MEMBER FOR DOUBLE DOORS

BACKGROUND OF THE INVENTION

1. Field of the Invention

The invention refers to door insulating devices; and, more particularly, to an insulating device adapted to be mounted between a pair of abutting double doors.

2. Description of the Prior Art

Many homes and the like have abutting adjacent double doors. Generally speaking, such doors may have a space at the bottom thereof between the floor and the bottom edge of the doors. In today's energy conscious society, it is necessary to seal off such space. In the past, elongated flaps, such as metal strips having resilient downwardly extending flanges were secured to such doors along their bottom edges sealing off cold air from the outside. However, a space is formed between the double doors along their line of intersection at the bottom thereof which is not closed off by such strips. There thus exists a need for quickly and easily closing off such areas in an inexpensive manner that is easy to install.

SUMMARY OF THE INVENTION

It is an object of this invention to provide an improved seal for closing off the space formed at the bottom between abutting double doors.

It is a further object of this invention to provide an insulating member for installation on double doors for insulating the doors.

These and other objects are preferably accomplished by providing an insulating member comprising a flat flange portion adapted to be secured to one of a pair of double doors including a resilient deformable portion extending below the door on which it is mounted and providing sealing insulation when the other door is closed with respect to the door on which the flat portion is installed.

DESCRIPTION OF THE PREFERRED EMBODIMENT

Figure 1:
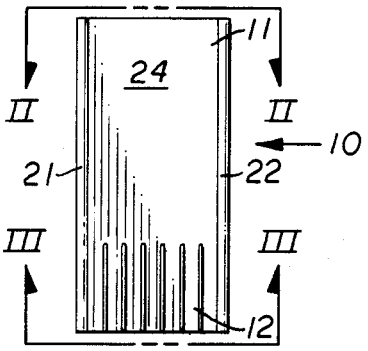
FIG. 1 is a vertical front view of an insulating device in accordance with the invention.
Figure 2:
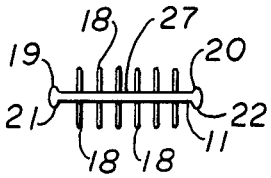
FIG. 2 and 3 are views taken along lines II—II and III—III, respectively.
Figure 3:
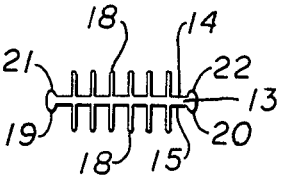

An insulating member of device 10 in accordance with the invention is shown in vertical front view in FIG. 1. Device 10 includes a first flat planar portion 11, which may be rectangularly shaped, as shown, and a lower deformable portion 12. As seen in FIGS. 2 and 3, portion 12 is comprised of deformable section 13 having a pair of face surfaces 14, 15 each of which has a plurality of resilient fingers or flanges 18, such as the six spaced flanges, are provided extending radially outwardly, as shown.

The lower portion 12 and upper portion 11 may have elongated support side ribs 19, 20 and 21, 22 respectively at each end of the planar sections on opposite sides thereof.

The entire device 10 may be made from one piece of resilient material, such as rubber, or made from separate elements also of a resilient material, all secured together. The face 27 (opposite side of portion 11 in FIG. 1—see FIG. 2) may be provided with an adhesive, if desired, for reasons to be discussed. Of course, the device 10 can be secured in other ways, such as by providing screw holes therein, not seen in face 24. The resilient fingers 18 provide deformable means which means also serve to seal any spaces of abutting members as will be discussed.

Figure 4:
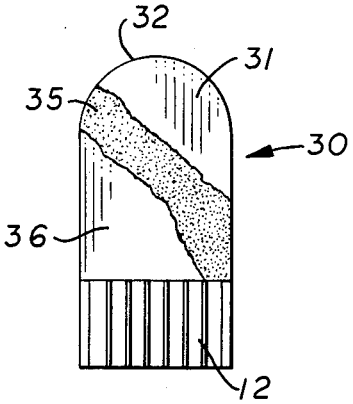
FIG. 4 is a vertical view from the front of a modification of the device of FIG. 1.

Before discussing the application of device 10 to a double door assembly, it should be noted that the exact configuration of device 10 is a matter of design choice as long as the device functions as hereinafter disclosed. For example, as can be seen in FIG. 4, wherein a modified device 30 is shown, portion 31 is otherwise identical to portion 11 but rounded at the top 32 as shown. Portion 12 is identical to portion 12 of the embodiment of FIGS. 1 to 3, but for inclusion of optional adhesive layer 35, protected from dirt etc by peel over cover layer 36, both shown in cutaway.

Figure 7:
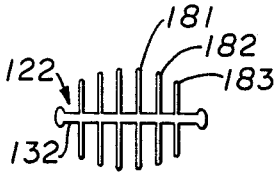
FIG. 7 is a top plan view of a variant of the device of FIG. 1.

In the embodiment of FIG. 7, device 100 as seen from the underside has a lower deformable portion 122 has a deformable section 132 to which are mounted a plurality of resilient, generally normally extending fingers, of different lengths, designated 181, 182 and 183.

The dimensions of device 10 are also a matter of design choice and of course dependent on the size and configuration of the doors in which they are installed. For example, the overall length of devices 10 and 30 may be about 2 inches and the overall width may be about 1 inch with portion 12 being about 9/16 inches in length, the overall thickness being about 1 and 1/16 inches (½ inch for each section 13, 14 and about 1/16 inch for the abutting flanges).

Figure 5:
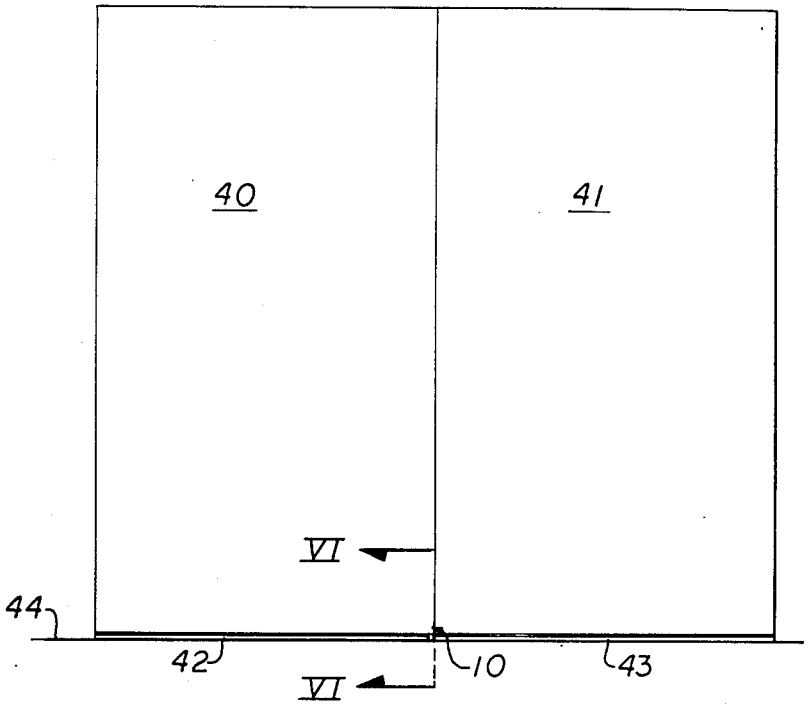
FIG. 5 is a vertical view of a pair of double doors having the device of FIGS. 1 and 3 installed thereon.
Figure 6:
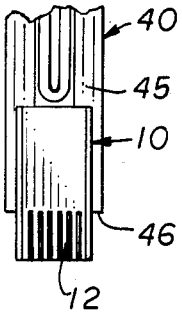
FIG. 6 is a view taken along lines VI—VI of FIG. 5.

As shown in FIG. 5, the device 10 is shown as mounted between a pair of adjacent abutting double doors 40, 41. Each door 40 and 41 may have an insulating strip 42 43 respectively, at the bottom thereof for sealing off air flow under doors 40, 41 and between the doors 40, 41 and floor or surface 44. However, as heretofore discussed, no provision is usually made on such doors for the space between strips 42, 43 at the intersection of doors 40, 41. As shown in FIG. 6, the device 10 is glued or otherwise secured to the bottom side edge 45 of door 40 so that the deformable portion 12 extends below the bottom edge 46 of door 40 and is deformed when the doors are closed and in abutting relationship. Thus, door 40 may be locked with door 41 opened and closed. When door 41 is in the position shown in FIG. 5, the portion 12 is deformed and seals off the space between doors 40, 41 at their bottom intersection providing complete and full weatherstripping for the doors.

Figure 8:
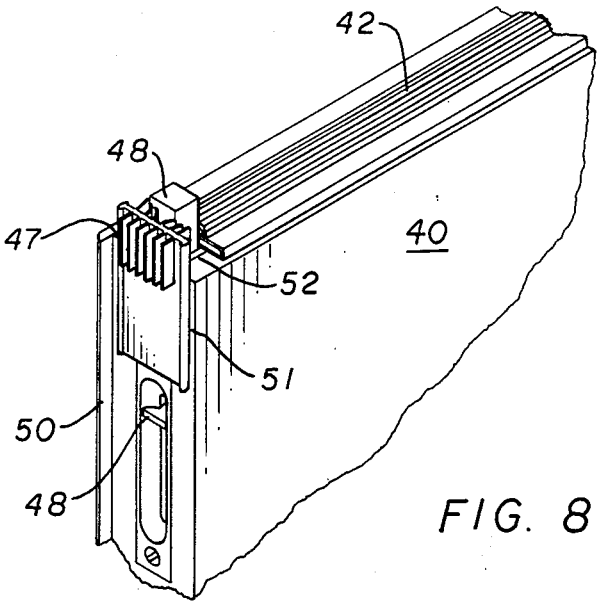
FIG. 8 is a bottom perspective view of one door of double doors.

By reference to FIG. 8 it will be appreciated that the instant device while mounted on the side of the door 40 beneath the pin lock 48, at door area 51, the deformable portion occupies space in zone 52 on the underside of the door between the door corner 47 and the weatherstrip 42 overlying a section of the said pin lock 48, but spaced slightly from the pin 49.

The weatherstrip 42 can not occupy this space, due to the inherent limitation in the construction of weatherstrip 42 which prevents it from extending past its intersection with vertical moulding 50.

It can be seen that there is disclosed a device 10 which is inexpensive and easy to manufacture, can be quickly and easily installed, yet provides sealing means between the bottoms of double doors at their intersection.

Since certain changes may be made in the above apparatus without departing from the scope of the invention involved herein, it is intended that all matter contained in the above description and shown in the accompanying drawings shall be interpreted as illustrative and not in a limiting sense.

I claim:

1. Improved insulating means for a pair of double doors mounted in a door opening having a floor wherein the bottom of said doors at the intersection thereof forms a space between the doors and the floor, the improvement comprising;

an insulating device having a flat planar portion secured to the side edge of one of said doors having an integral lower deformable portion extending downwardly from said planar portion into the space formed between the doors and the floor, said lower deformable portion being comprised of a deformable section having a plurality of outwardly extending spaced resilient fingers thereon.

2. In the insulating means of claim 1 wherein each of said plurality of outwardly extending spaced resilient fingers extends substantially the same distance.

3. In the device of claim 2 wherein the fingers at the extremities of said deformable section extend out less than the fingers intermediate said section.

4. In the device of claim 3 wherein said deformable portion is of a resilient material.

5. In the device of claim 4 wherein said resilient material is rubber.

* * * * *